US006481870B2

(12) United States Patent
Son

(10) Patent No.: US 6,481,870 B2
(45) Date of Patent: Nov. 19, 2002

(54) EMERGENCY LIGHTING FIXTURE

(76) Inventor: Jae-Sul Son, Hugokmaul Apartment Bldg. #808 Apt. #301, 1057 Iisan-dong, Iisan-gu, Goyang-city, Gyunggi-do (KR)

( * ) Notice: Subject to any disclaimer, the term of this patent is extended or adjusted under 35 U.S.C. 154(b) by 0 days.

(21) Appl. No.: 09/775,390

(22) Filed: Feb. 1, 2001

(65) Prior Publication Data

US 2001/0014020 A1 Aug. 16, 2001

(30) Foreign Application Priority Data

Feb. 12, 2000 (KR) ..... 00-6607
Jan. 4, 2001 (KR) ..... 01-442

(51) Int. Cl.[7] ..... F21K 7/00; G09F 13/06

(52) U.S. Cl. ..... 362/259; 362/812; 362/20; 40/570

(58) Field of Search ..... 362/259, 183, 362/812, 228, 147, 20, 234, 252; 116/7; 40/570, 564, 480, 502, 541, 550, 452

(56) References Cited

U.S. PATENT DOCUMENTS 4,739,508 A * 4/1988 Clark ..... 372/95
4,967,317 A * 10/1990 Plumly ..... 40/570
5,151,679 A * 9/1992 Dimmick ..... 340/326
5,842,297 A * 12/1998 Tung ..... 40/546
5,966,069 A * 10/1999 Zmurk et al. ..... 340/330

* cited by examiner

*Primary Examiner*—Sandra O'Shea
*Assistant Examiner*—Bao Truong
(74) *Attorney, Agent, or Firm*—Lee & Hong

(57) ABSTRACT

An emergency lighting fixture includes a frame employing an indicator on the front of the frame, an illumination lamp installed in the inside of the frame, a laser projector exposed to the front of the frame from the inside of the frame, an angle adjusting unit for adjusting a projecting angle of the laser projector, and an emergency power supplying battery, installed in the inside of the frame, for impressing a power supply into the illuminating lamp and the laser projector in response to a signal of a fire sensor in the event of fire.

4 Claims, 8 Drawing Sheets

EMERGENCY LIGHTING FIXTURE

FIELD OF THE INVENTION

The present invention relates generally to emergency lighting fixtures and particularly relates to combinations of illuminated exit signs and the like with emergency lighting units to form fixtures having multiple emergency lighting functions in a single device.

BACKGROUND OF THE INVENTION

Emergency lighting is necessary to guide people to safety in the event of an emergency situation such as a fire or a shutdown of a normal power. The most common type of emergency lighting is the exit sign which is also the most noticed not only due to its ubiquity but also due to the fact that most exit signs are constantly illuminated and are therefore readily seen. Exit signs are typically placed above doorways or in egress paths to indicate the most efficient manner of exiting a building when emergency occurs.

FIG. 1 shows a construction of a general emergency lighting fixture in a dissembled view. As shown in FIG. 1, the conventional emergency lighting fixture is formed of a metal frame 1, an indicator 2 installed on the front of the metal frame 1, and an illumination lamp 3 installed in the inside of the frame 1.

The indicator 2 is made of transparent or translucent plastic material in order to display the letter clearly when the illumination lamp 3 is turned on. The letter "EXIT" marked on the front surface of the indicator 2 is usually made with a written form or an engraved style. It is general to use a fluorescent light as the illumination lamp 3. An emergency power supplying battery 4 is provided to maintain a power supply condition for the indicator 2 even when a main power is lost, securing a normally on-state of the indicator 2 nevertheless of an existence of the main power. The fire sensor 6 detects the fire and transmits an electric signal in order to shut off the main power. A housing 5 covers the front portion of the frame 1.

However, since it is hard for the fluorescent light of the conventional emergency lighting fixture to provide an efficient facility of straightness (the feature characterized by how far the light proceeds along an unilateral direction without dispersion), the light from the fluorescent lamp is scattered before proceeding with a required distance through a dense smoke. Substantially, the fluorescent light faintly brightens around the exit, but cannot make people being far away from an exit identify an exact location of the exit. As a result, such insufficient indication performance of the fluorescent lamp may not be helpful to save life damage in the event of fire accompanying a lot of smoke or dust.

SUMMARY OF THE INVENTION

It is therefore an object of the present invention to provide an emergency lighting fixture for minimizing life damages by identifying effectively a location of the exit under the thick smoke or dust in the building when an emergency such as a fire or an earthquake occurs.

In order to attain the above object, according to an aspect of the present invention, there is provided an emergency lighting fixture including: a frame employing an indicator on the front of the frame; an illumination lamp installed in the inside of the frame; a laser projector exposed to the front of the frame from the inside of the frame; and an emergency power supplying battery, installed in the inside of the frame, for impressing a power supply into the illuminating lamp and the laser projector in response to a signal of a fire sensor in the event of fire.

According to an emergency lighting fixture of the present invention, in the event of fire, the laser projector is activated by a power supply from the batter in response to a signal from the fire sensor, so that laser beams from the laser projector let sheltering people identify a location of an exit door easily and rapidly.

The present invention will be better understood from the following detailed description of the exemplary embodiment thereof taken in conjunction with the accompanying drawings, and its scope will be pointed out in the appended claims.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

In the following description for purposes of explanation, specific numbers, materials and configurations are set forth in order to provide a thorough understanding of the present invention. However, it will be apparent to one skilled in the art that the present invention may be practiced without the specific details.

Figure 1:
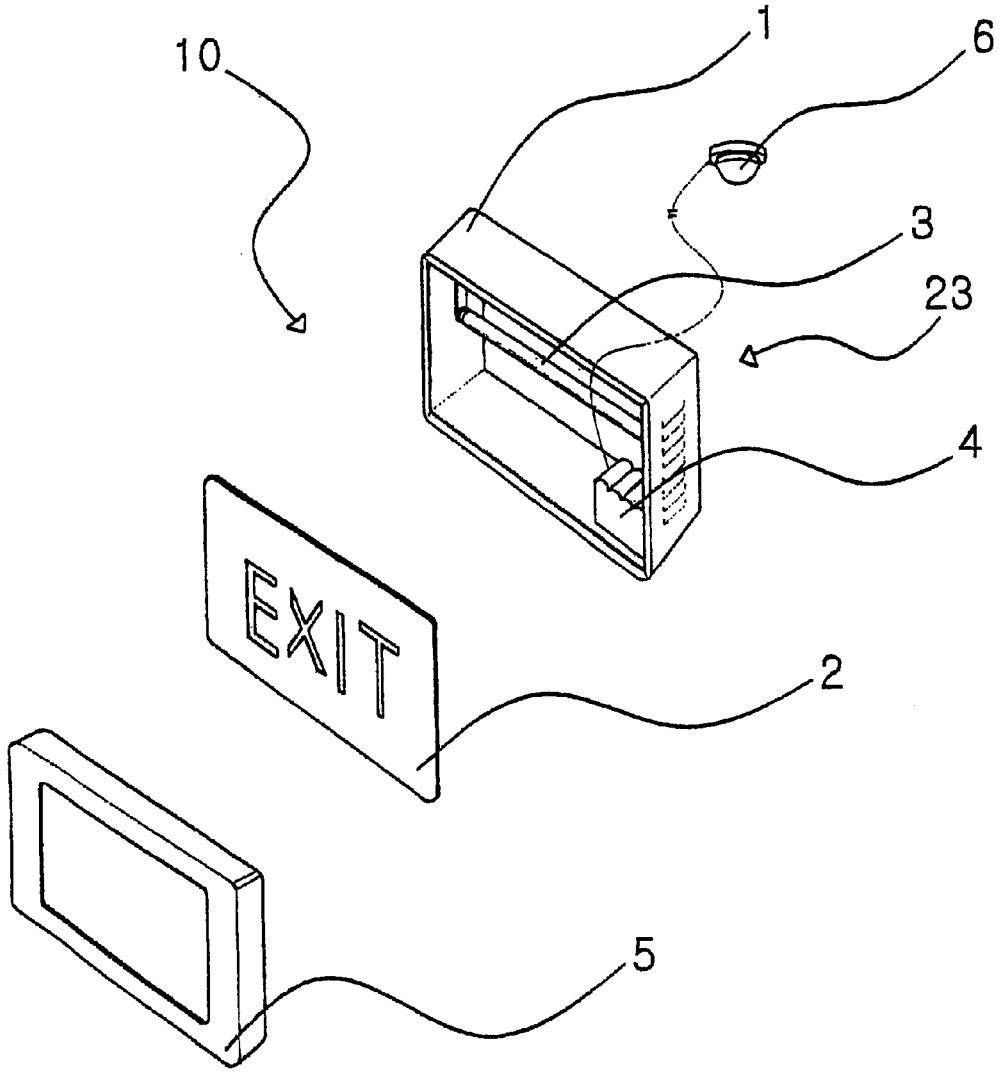
FIG. 1 is a disassembled perspective showing an emergency lighting fixture of the conventional art.
Figure 2:
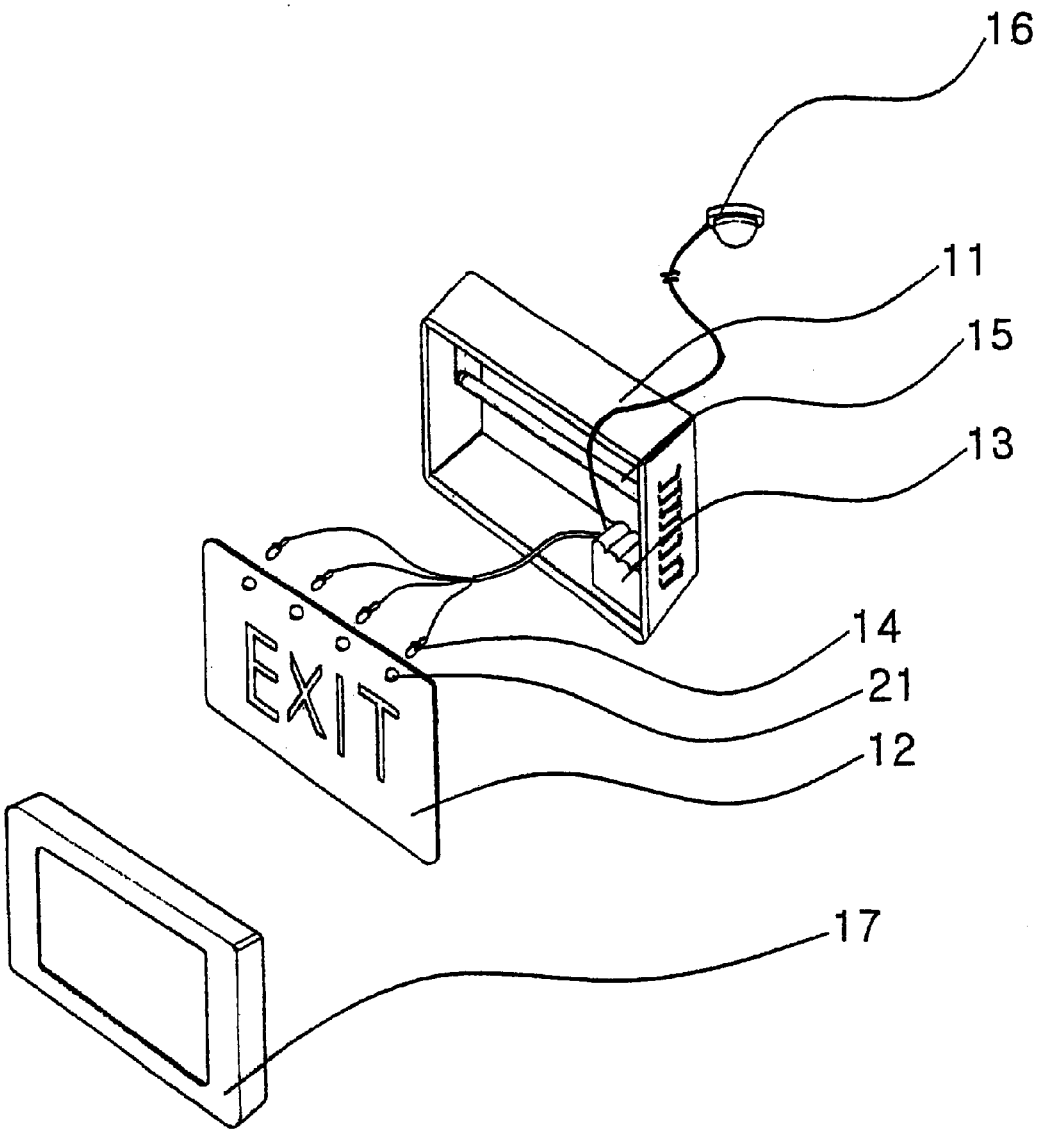
FIG. 2 is a disassembled perspective showing an emergency lighting fixture of a preferred embodiment according to the present invention.
Figure 3:
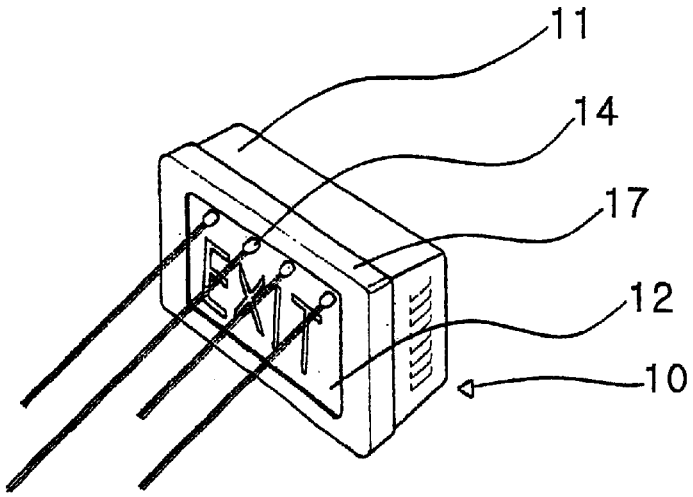
FIG. 3 is an assembled perspective showing the emergency lighting fixture of FIG. 2, illustrating use with laser projection from the fixture.
Figure 4:
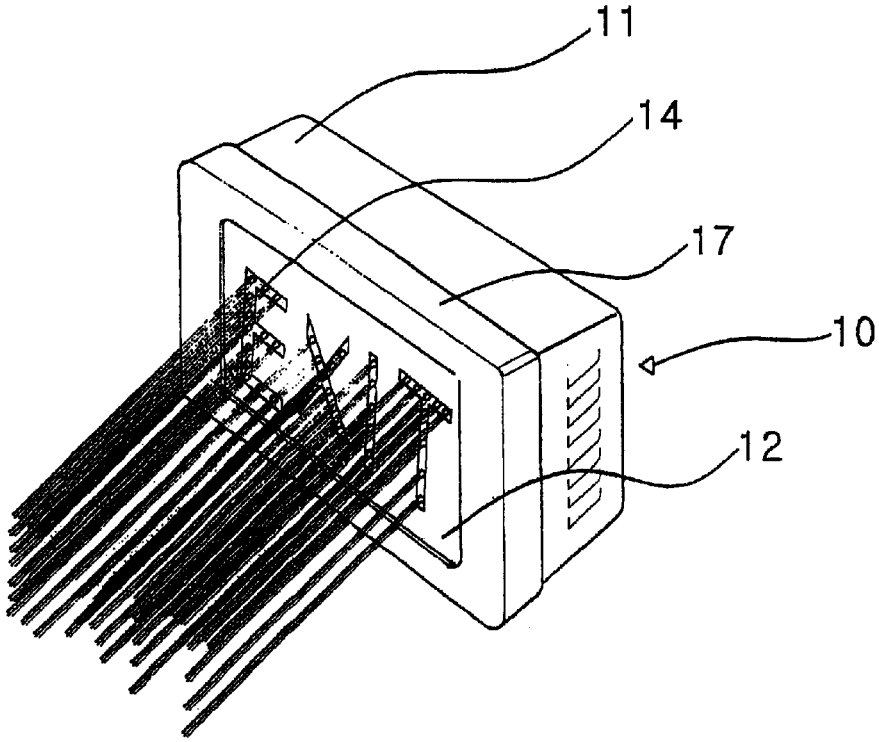
FIG. 4 is an assembled perspective showing the emergency lighting fixture of Fig.2, illustrating an embodiment of an indicator employing a laser projector.
Figure 5:
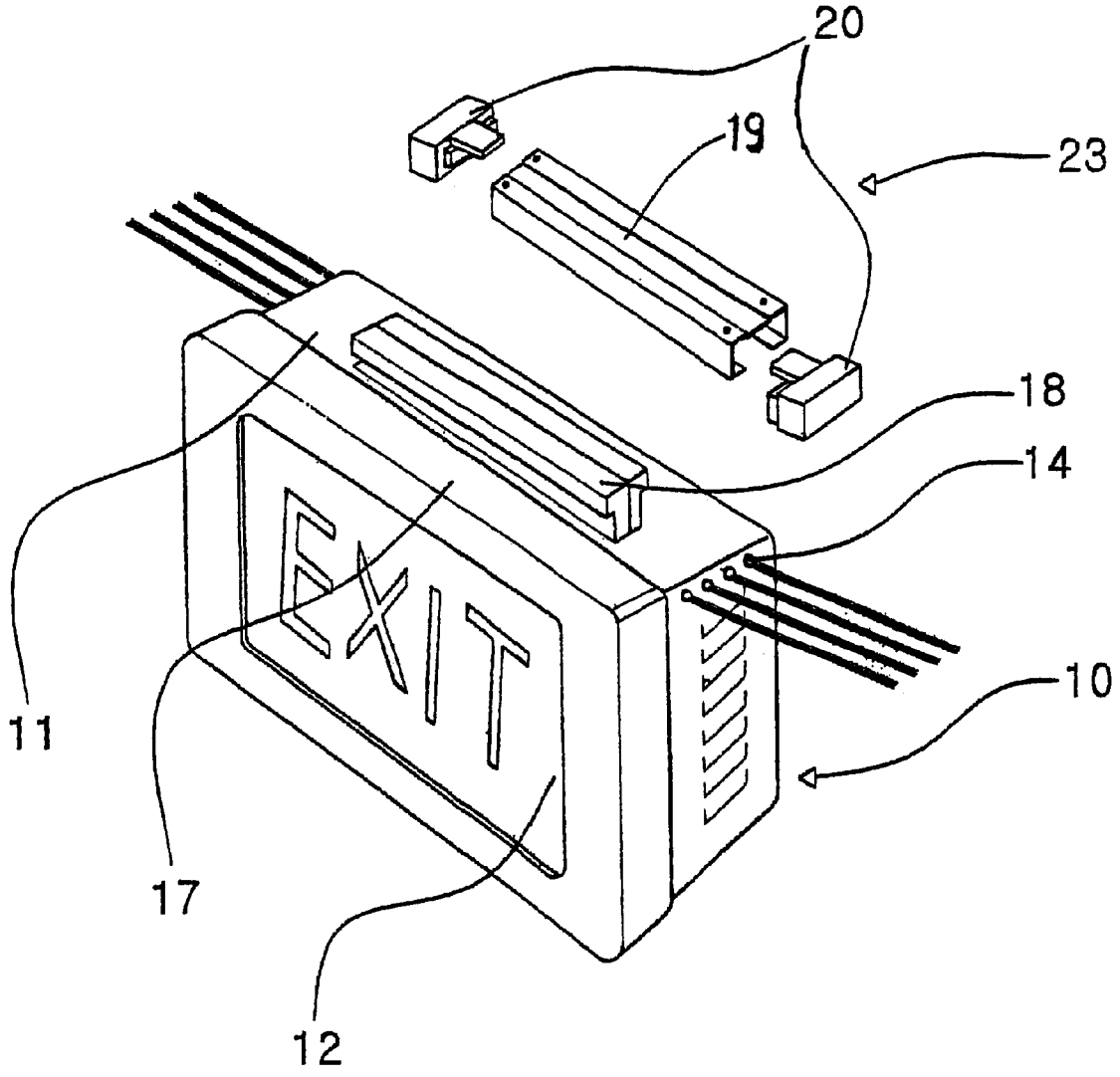
FIG. 5 is a disassembled perspective of the present emergency lighting fixture and a settling unit which fixes the lighting fixture on a ceiling, illustrating another style of the laser projection.
Figure 6:
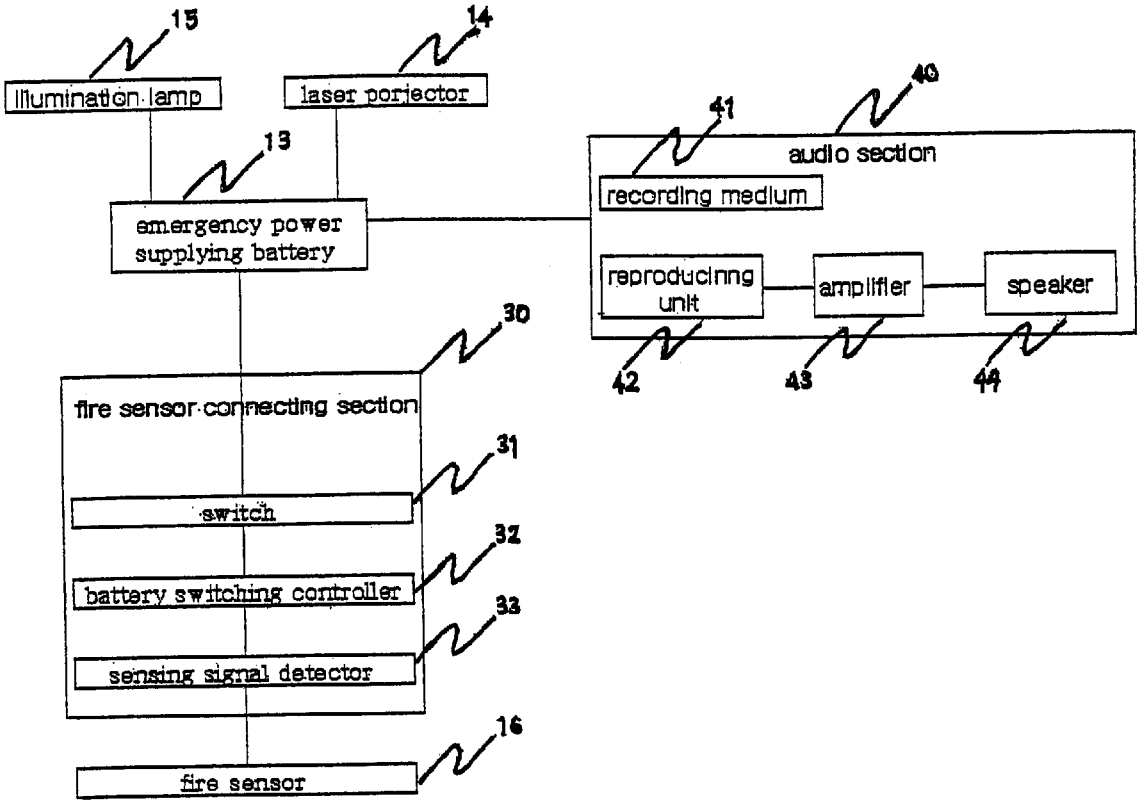
FIG. 6 is a functional block diagram of an electrical circuit part employed in the emergency lighting fixture of the present invention.

FIG. 2 is a disassembled perspective showing an emergency lighting fixture of a preferred embodiment according to the present invention. FIG. 3 is an assembled perspective showing the emergency lighting fixture of FIG. 2, illustrating use with laser projection from the fixture. FIG. 4 is an assembled perspective showing the emergency lighting fixture of FIG. 2, illustrating an embodiment of an indicator employing a laser projector. FIG. 5 is a disassembled perspective of the present emergency lighting fixture and a settling unit which fixes the lighting fixture on a ceiling, illustrating another style of the laser projection. FIG. 6 is a functional block diagram of an electrical circuit part employed in the emergency lighting fixture of the present invention.

Referring to FIGS. 2 through FIG. 6, the emergency lighting fixture 10 of the present invention is formed of a frame 11 equipping an indicator 12 on its front side for displaying a location of an exit door in a building, an illumination lamp 15, an emergency power supplying battery 13, and a laser projector 14.

In addition, a housing 17, which is made of stainless steel frame jointed with a transparent plate such as a glass, can be equipped on the front of the frame 11.

The illumination lamp 15 is installed in the inside of the frame 11 and illuminates the indicator 12 when a power is impressed thereto. The illumination lamp 15 is connected with both a main power source and the emergency power supplying battery 13. Here, the indicator 12 is activated by receiving a power supplied from a main power source in a normal state, or by receiving a power from the emergency power supplying battery 13 in an emergency state where the main power source are shut off.

The emergency power supplying battery 13 is installed in the inside of the frame 11, supplying a power to the illumination lamp 15 and the laser projector 14 when the main power in the building is shut off due to a fire.

The fire sensor 16 is usually installed in the building, and connected to a fire alarm and a power source shut-off unit. Accordingly, in the event of fire, the fire sensor 16 recognizes current degree of a heat or a smoke in order to apply a fire-warning signal to the fire alarm, and transmits an electric signal to the power shut-off unit for turning the main power off.

An embodiment of a fire sensor connecting section 30, for making the emergency power supplying battery 13 be operable by recognizing the electric signal generated from the fire sensor 16 when an emergency occurs, is shown in FIG. 6. Referring to FIG. 6, the fire sensor connecting section 30 is formed of a sensing signal detector 33 for recognizing the electric signal which is generated from various sensors during an emergency, a switch 31 for turning the power of the emergency power supplying battery 13 on or off, and a battery switching controller 32 for turning the switch of the battery 13 on when the electric signal is generated from the sensing signal detector 33 so that the battery 13 generates a power source instead of the shut-off main power.

In addition, the fire sensor connecting section 30 may be constructed in various manners by using known techniques about switching.

Meanwhile, the laser projector 14 employs a usual laser that projects the laser beam with a monochromatic light by means of a laser oscillator.

There are various types of laser oscillators adaptable to the laser projector 14. The laser oscillators, composed of a laser medium, an excitation medium, and a resonator, are classified into a helium-neon laser, a $CO_2$ laser, a semiconductor laser, etc., depending on the types of the laser medium and the excitation medium.

It is desirable to use the semiconductor laser in the laser oscillator for an embodiment of the invention. As the semiconductor laser has not only less power consumption but also a low price because of a small size and a high oscillating efficiency, it is appropriate that the semiconductor laser is well adaptable to the emergency lighting fixture 10 that is in need of mass production.

It should be desirable that a power level of the laser is less than 5 watt because that there would be dangerous to human's eyesight when a laser beam over 5 watt is directly exposed on to human's eyes.

The indicator 12 has opening holes 21 to render laser beams to be come out of the indicator from the laser projector 14, as shown in FIG. 3.

Further, the laser projector 14 is pertinently arranged with regularly predetermined pitches corresponding to a pattern of letters or signs designed on the indicator 12. The laser projector 14 is otherwise disposed in the left and right sides of the fixture 10 and thereby laser beams thereof are projected from the both sides as shown in FIG. 5, which is more effective in the case of that the emergency lighting fixture 10 is fixed on a ceiling.

Like those features, positions and angles of the laser projector 14 are variously modified dependent upon a peripheral environment or a situational efficiency.

Besides, according to an embodiment of the present invention, the emergency lighting fixture 10 has an angle adjusting unit 22 for varying to projection angles of the projector 14 in right, left, up, or down corresponding to environmental needs.

Figure 7:
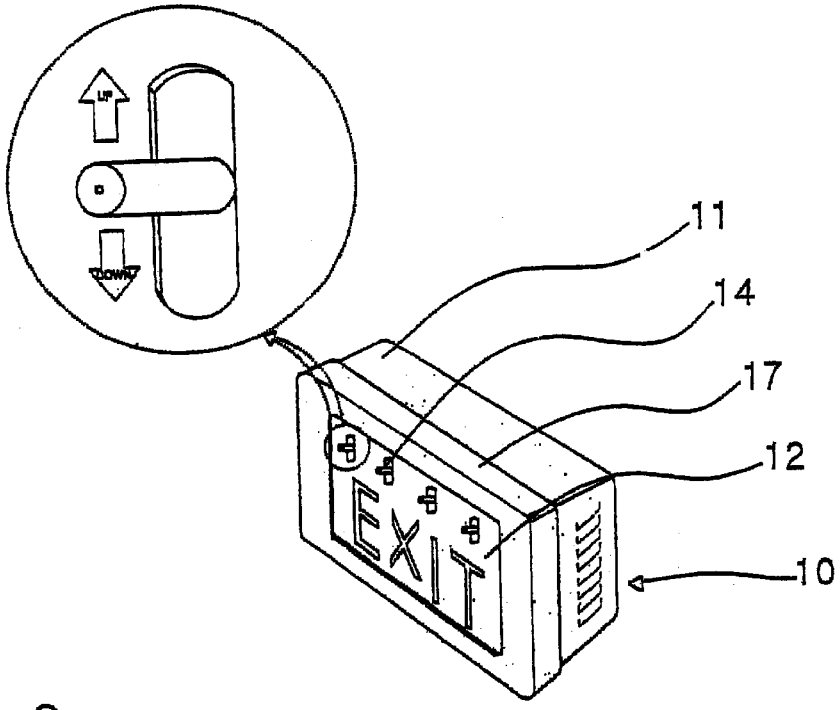
FIG. 7 is a perspective showing an embodiment of an emergency lighting fixture employing an angle adjusting unit.
Figure 8:
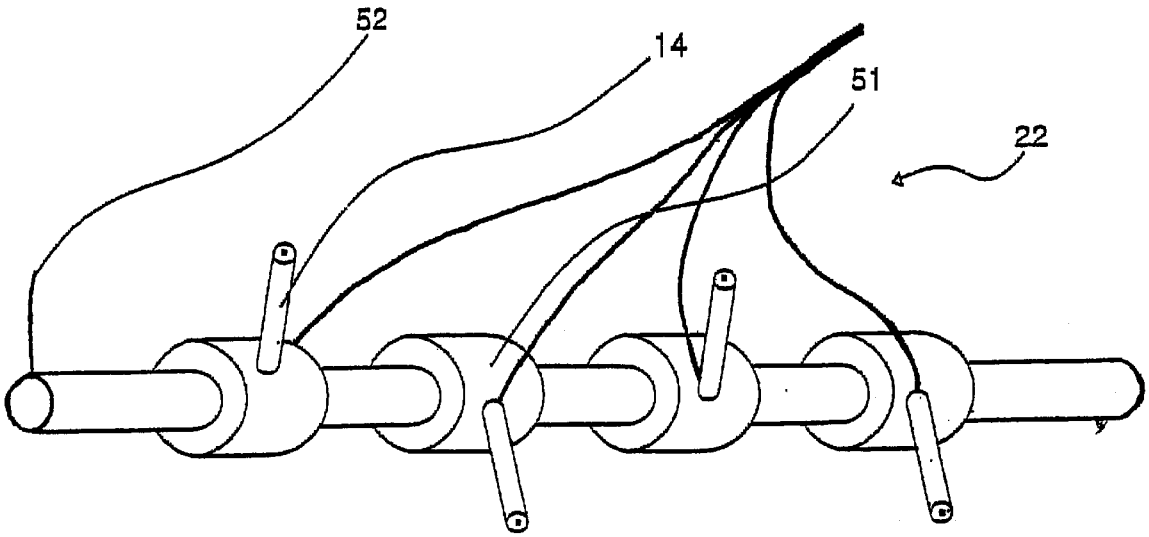
FIG. 8 is a perspective showing a shape of the angle adjusting unit of FIG. 7 in detail.

FIG. 7 shows an emergency lighting fixture embodied with the angle adjusting unit 22, and FIG. 8 shows a configuration of the angle adjusting unit 22 of FIG. 7. Referring to FIGS. 7 and 8, the angle adjusting unit is composed of a rotation body 51 supporting the laser projector 14, and a pivot 52 which serves as an axis for the rotation body 51 revolving up and down on the axis to adjust the projection angles.

Both ends of the pivot 52 are fixed on the inside of the frame 11. The pivot 52 is inserted through the rotation body 51, and then the rotation body 51 revolves on the pivot 52.

According to the present invention, as shown in FIG. 5, the emergency lighting fixture 10 combines to a settling unit 23 to be fixed on a ceiling.

Referring to FIG. 5, the settling unit 23 is constructed of a projection latch 18 in which the upper part is wide and the lower part is narrow so that a lengthwise groove is formed therein, a latch frame 19 formed to be engaged with the latch 18 in a lockable state within the groove provided therein, and a frame stop 20 inserted at both ends of the slot of the latch frame 19.

It is possible to fix the fixture 10 on a ceiling by other ways. For instance, the fixture 10 can be hang on a ceiling by boring holes through the frame 11 and then bolting the fixture 10 on a ceiling.

On the indicator 12, a letter or an arrow indicating a direction of an exit door is inscribed. It may be proper to use material made of polycarbonate.

Polycarbonate is characterized with a strong heat resistance that provides endurance to the indicator 12 from being deformed by heat, and with a higher fire-resistance that provides hard maintenance even in a blaze of fire. Such hardness of polycarbonate secures a reliable indication to the indicator, maintaining the sign "EXIT" without deformation or destruction.

Further, an excellent transparency of polycarbonate is helpful in transmitting the light from the illumination lamp 15 through the indicator 12 at the highest degree.

Meanwhile, referring to FIG. 6, the emergency lighting fixture 10 has an audio section 40 for generating a sound signal to voicing a location of an exit door by being impressed the power from the emergency power supplying battery 13.

The audio section 40 may be of one of conventional audio systems as shown in FIG. 6.

The audio section 40 is comprised of a recording medium 41 for recoding an audio data notifying a location of an exit door, a reproducing unit 42 for converting the audio data stored in the recording medium 41 into electrical signals in response to a power supply from the emergency power supplying battery 13, an amplifier 43 for amplifying the reproduced electric signals, and a speaker 44 for converting the amplified electric signals into sound signals.

The recording medium 41 can record a short sentence such as "the exit is located in the opposite to the entrance" to explain easily a location of an exit door to people.

The reproducing unit 42 can be configured with a cassette deck, a compact disk player, or an MP3 player, etc., being subjected to the kind of the recording medium 41.

The speaker 44 is disposed in the inside of the emergency lighting fixture 10 or in a proper position out of fixture 10.

It is preferred such that the emergency lighting fixture 10 employing the audio section 40 is deposited on one or two places in a building. Too many dispositions of the sounded fixture in a building cause people to be struggled to correctly hear the announcement.

An operation of the present invention will be described in detail hereinafter, referring to the accompanying drawings.

First, the emergency lighting fixtures 10 are positioned at desirably predetermined places in a building, and then setting laser projection angles of the laser projector 14 by using the angle adjusting unit 22.

Once fire occurs, the fire sensor 16 detects a current degree of heat strength or smoke density, and sends a signal to the power shut-off unit for shutting a main power off.

At the same time, the fire sensor 16 transfers an electric signal to the sensing signal detector 33 of the fire sensor connecting section 30 equipped in the emergency lighting fixture 10.

The sensing signal detector 33 applies the electric signal to the battery switching controller 32 after recognizing the electric signal, and thereby the battery switching controller 32 turns the switch 31 on in order to make the emergency power supplying battery 13 be operable.

The emergency power supplying battery 13 supplies an emergency power to the illumination lamp 15 and the laser projector 14, so that the illumination lamp 15 is turned on and the laser projector 14 generates laser beams.

And, the audio section 40 notifies a location of an exit door to people by turning the recorded sound "the exit is . . . " out of the recording medium 41.

Once the illumination lamp 15 is turned on, the lamp keeps lightening to illuminate the indicator 12 marked as "EXIT".

The fluorescent light from the illumination lamp 15 just brightens near an exit door in a dark fire smoke, being scattered through the heavy smoke, not proceeding ahead enough, because of its poor straightness (the feature characterized by how far the light proceeds along an unilateral direction without dispersion).

On the other hand, the laser beam proceeds straight owing to the excellent straightness. Thus, the laser beam is capable of notifying people distanced far from an exit door or a location near the exit door.

Figure 9:
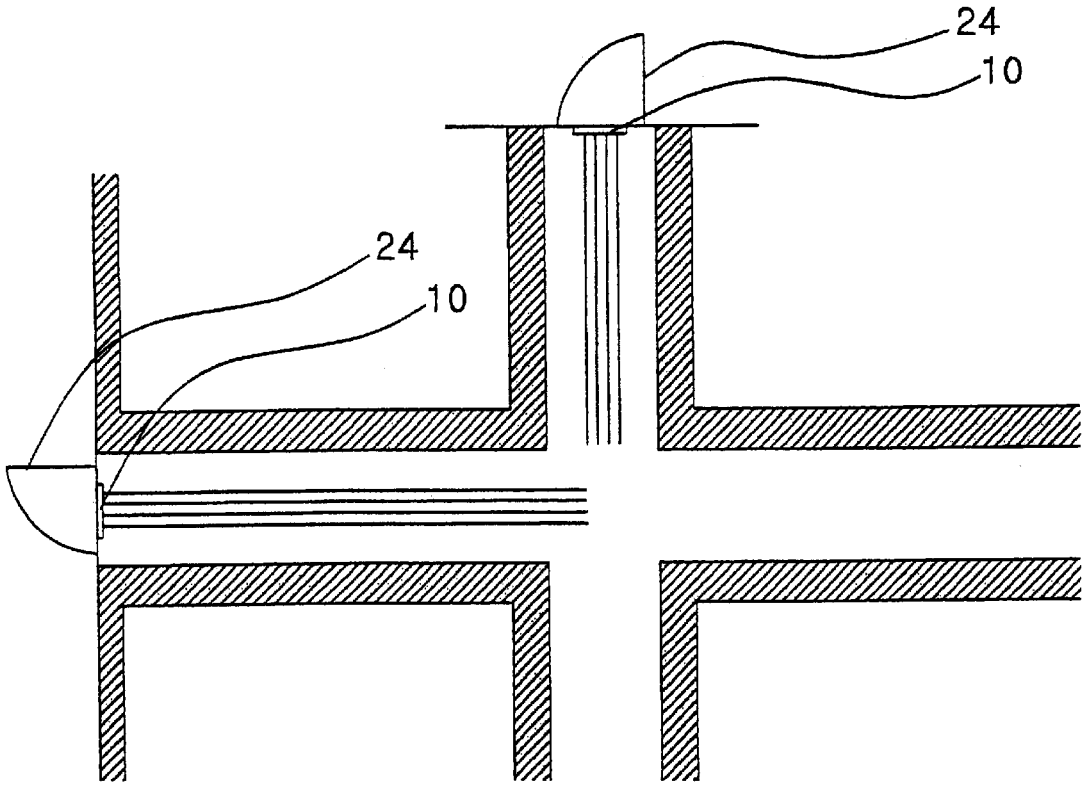
FIGS. 9 and 10 are schematic top views illustrating examples of arrangements with the emergency lighting fixture disposed in a building.
Figure 10:
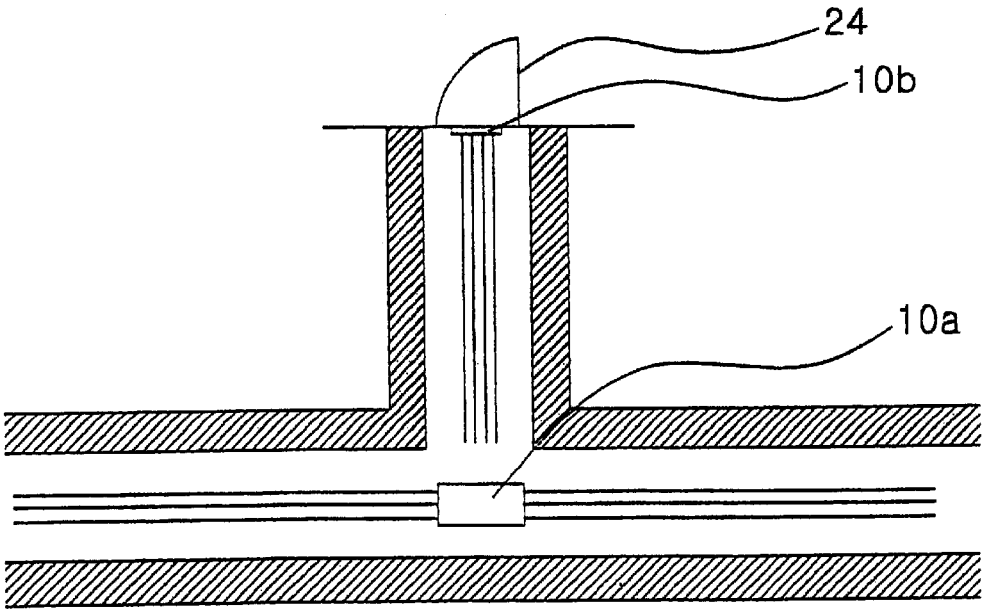
Figure 11:
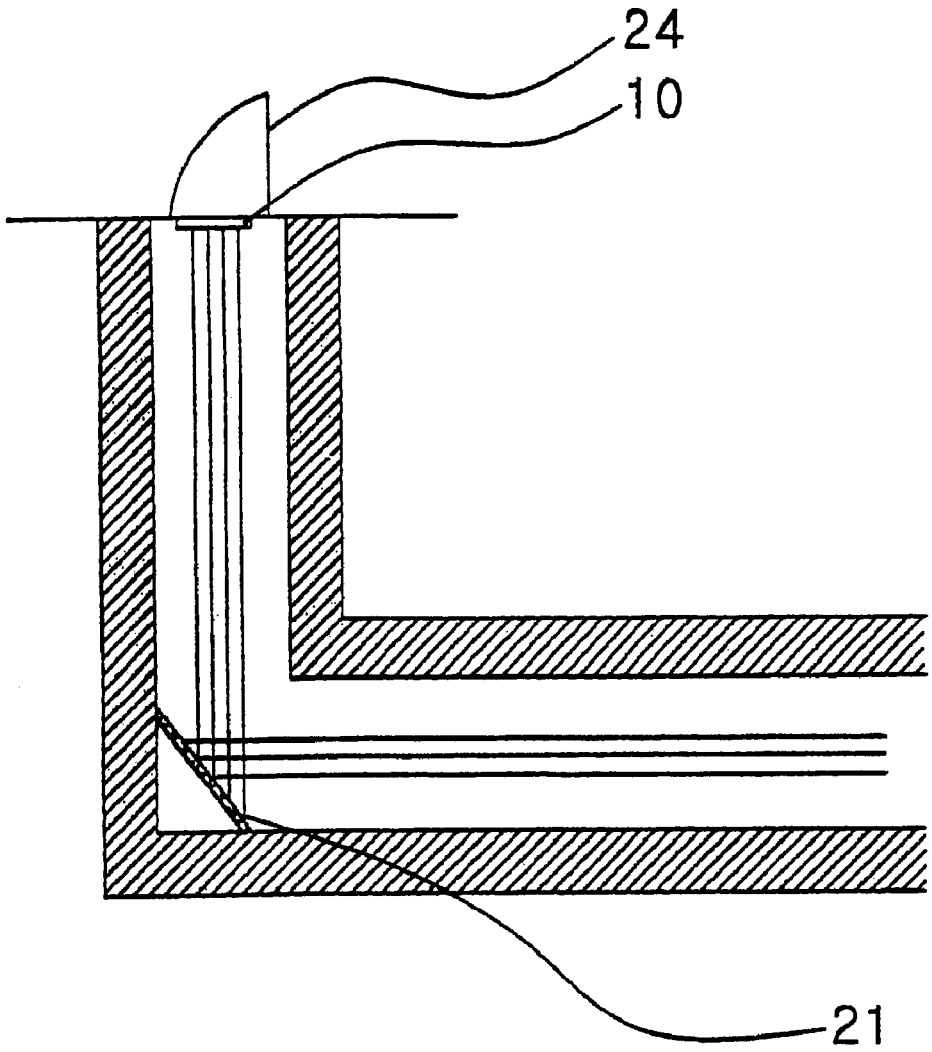
FIG. 11 is a schematic top view illustrating another example of arrangement with the emergency lighting fixture disposed in a building, being cooperated with a mirror.

FIGS. 9 and 10 are schematic top views illustrating examples of arrangements with the emergency lighting fixture disposed in a building. FIG. 11 is a schematic top view illustrating another example of arrangement with the emergency lighting fixture disposed in a building, being cooperated with a mirror.

Referring to FIGS. 9 through 11, for the purpose of that people who are looking for the exit under a heavy fire smoke can easily find out the laser beam which guides the proceeding route leading them to an exit location throughout the smoke.

Sheltering people, who desire to escape out of a pressing danger due to a fire in a building, first identifies laser beam and follows a direction guided by the laser beams to reach an exit door.

If the structure of passages in a building is complex, a joint disposition with the emergency lighting fixtures 10 on a ceiling and a wall in appropriate positions can effectively guide people to an exit door 24, as shown in FIG. 10. Here, the emergency lighting fixture 10*a* on a ceiling is fixed by means of the settling unit 23 as shown in FIG. 5, and is configured to project laser beams from the right and left sides of the fixture. In that case, after reaching the fixture 10*a* on the ceiling by following the laser beams therefrom, people identify the direction of the exit door 24 above which the sign "EXIT" is seen by the indicator 12 of the fixture 10*b*, and then follow the laser beam lead from the direction of the fixture 10*b*, finally reaching the nearest exit (e.g., the exit door 24) without missing or disordering.

Going through the aforementioned progress, sheltering people can escape from the fire by identifying the emergency lighting fixtures 10*a* and 10*b* after being guided to the around of the exit door.

Furthermore, referring to FIG. 11, the number of the emergency lighting fixtures that should be installed can be reduced by installing a mirror 21 on a corner of the building passage. The mirror 21 reflects laser beams from the fixture 10 thereon, and thereby make the laser beams appear throughout a complex passage being curved, or rectangle.

As described above, according to the present invention, the life damage caused from the fire can be minimized by installing the emergency lighting fixture 10, because people can find the exit easily and rapidly by following the guidance with the laser beams even in the heavy smoke.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An emergency lighting fixture comprising:

a frame employing an indicator on the front of the frame;

an illumination lamp installed in the inside of the frame;

one or more laser projectors exposed to the front of the frame from the inside of the frame;

an angle adjusting unit for adjusting a projecting angle of the laser projector, including a pivot installed transversely in the inside of the frame, and one or more rotation bodies which support the laser projectors; and an emergency power supplying battery, installed in the inside of the frame, for impressing a power supply into the illuminating lamp and the laser projectors in response to a signal of a fire sensor in the event of fire.

2. The emergency lighting fixture as claimed in claim 1, wherein the laser projector is arranged in correspondence with a pattern of a letter or a sign formed on the indicator.

3. The emergency lighting fixture as claimed in claim 1, further comprising an audio section for generating a sound signal to notify a location of an exit door in response to a power supply from the emergency power supplying battery in case of an emergency.

4. An emergency lighting fixture comprising:

a frame employing an indicator on the front of the frame;

an illumination lamp installed in the inside of the frame;

one or more laser projectors installed to make laser beams be projected from right and left sides of the emergency lighting fixture; and an emergency power supplying battery, installed in the inside of the frame, for impressing a power supply into the illuminating lamp and the laser projectors in response to a signal of a fire sensor in the event of fire.

* * * * *